US008048273B2

(12) United States Patent
Lundberg et al.

(10) Patent No.: US 8,048,273 B2
(45) Date of Patent: Nov. 1, 2011

(54) ARRANGEMENT FOR TREATMENT OF CELLULOSE PULP

(75) Inventors: Jörgen T. Lundberg, Sundsvall (SE); Rickard Andersson, Matfors (SE); Johan Bylander, Sundsvall (SE); Magnus Henriksson, Sundsvall (SE)

(73) Assignee: Metso Paper, Inc. (FI)

( * ) Notice: Subject to any disclaimer, the term of this patent is extended or adjusted under 35 U.S.C. 154(b) by 563 days.

(21) Appl. No.: 11/921,496

(22) PCT Filed: May 31, 2006

(86) PCT No.: PCT/SE2006/050176

§ 371 (c)(1),
(2), (4) Date: Feb. 17, 2009

(87) PCT Pub. No.: WO2006/130110

PCT Pub. Date: Dec. 7, 2006

(65) Prior Publication Data

US 2009/0229778 A1 Sep. 17, 2009

(30) Foreign Application Priority Data

Jun. 3, 2005 (SE) ..... 0501291
Dec. 15, 2005 (SE) ..... 0502782

(51) Int. Cl.
*D21H 23/00* (2006.01)

(52) U.S. Cl. ..... 162/380

(58) Field of Classification Search ..... 162/380, 162/272, 326, 232; 134/115 R; 210/325, 210/404, 402

See application file for complete search history.

(56) References Cited

U.S. PATENT DOCUMENTS

| | | | | |
|---|---|---|---|---|
| 4,769,986 | A | 9/1988 | Kokkonen et al. | |
| 6,461,473 | B1 * | 10/2002 | Qvintus et al. | 162/43 |
| 7,695,591 | B2 * | 4/2010 | Lundberg et al. | 162/52 |
| 2008/0264113 | A1 * | 10/2008 | Andersson et al. | 68/93 |
| 2008/0314541 | A1 * | 12/2008 | Lundberg et al. | 162/232 |
| 2009/0218065 | A1 * | 9/2009 | Lundberg et al. | 162/380 |

FOREIGN PATENT DOCUMENTS

| | | | |
|---|---|---|---|
| EP | 0 239 312 | A1 | 9/1987 |
| EP | 0 315 737 | A1 | 5/1989 |
| WO | WO-97/10380 | A1 | 3/1997 |

* cited by examiner

*Primary Examiner* — Mark Halpern
(74) *Attorney, Agent, or Firm* — Lerner, David, Littenberg, Krumholz & Mentlik, LLP

(57) ABSTRACT

A washer for washing and dewatering of cellulose pulp is disclosed, comprising a rotatable drum with a plurality of outer compartments for the pulp to be washed defined by axial compartment walls distributed along the circumference of the drum, a stationary cylindrical casing that encloses the drum, whereby an annular space is defined between the casing and the drum, the annular space divided by means of longitudinal seals in the axial direction of the drum into zones for forming, washing and discharge of the pulp. At least two of the longitudinal seals are arranged such that, when the drum rotates, they meet compartment walls at shifted points in time with respect to each other. Preferably, all of these longitudinal seals are arranged along the circumference of the drum at different positions with respect to respective opposite axial compartment walls.

6 Claims, 3 Drawing Sheets

ARRANGEMENT FOR TREATMENT OF CELLULOSE PULP

This application is a 371 of PCT/SE2006/050176 filed on 31 May 2006.

FIELD OF THE INVENTION

The present invention relates to a washing arrangement for washing and dewatering of cellulose pulp of the type comprising a compartmented drum.

BACKGROUND OF THE INVENTION

All fiber lines comprise some type of washing equipment to separate the digestion liquor from the pulp. Later on in the process a washing arrangement is provided to separate bleaching liquors, after the bleaching stages. There are a number of different types of washing equipment which operate according to different principles.

A well-known type of washing arrangement is the drum washer, where the pulp is dewatered on a rotary filter drum after the addition of washing liquid, which displaces the liquor remaining on the pulp web after preceding process stages, for example a digestion stage or a bleaching stage. An underpressure within the drum causes the displaced liquid to pass through a perforated metal sheet located on the rotary drum. A further development of the original drum washer is the pressurized displacement washer, where the filtrate at over-pressure is caused to pass through the metal sheet. The increased pressure difference leads to an improved displacement of the filtrate.

According to a known design of a pressurized displacement washer, the drum is provided with compartments extending in the axial direction of drum and intended to be filled with pulp. The compartments are defined by walls in the form of bars arranged axially along the entire drum shaft, as well as a bottom that consists of the perforated metal sheet. The subdivided compartments of the drum ensure that the pulp cake does not break up and move, but instead maintains the form which is produced upon application of the pulp. The perforated metal sheet, on which the pulp deposits, is located at a distance from the main surface of the drum, so that filtrate channels are formed in the space between the drum and the metal sheet. Along the circumference of the drum there are at least as many filtrate channels as pulp compartments.

In a drum washer, a plurality of different washing stages can be carried out, with separate addition of washing liquid to the different stages, and also re-cycling of filtrate from one stage for use as washing liquid in another stage. In order to achieve maximum washing efficiency the objective is that washing liquid intended for a specific washing stage is not moved to a later washing stage. (Due to a pressure difference between the stages, supplied washing liquid tends to move towards the lower pressure.) In order to be able to separate different washing stages, carried out in one or more washing zones of the drum, and forming stages, carried out in the forming zone of the drum, and discharge stages, carried out in the discharge zone of the drum (enhanced pulp concentration zone constitutes a first part of the discharge zone), the respective zones are sealed by longitudinal (i.e. axial) seals. These longitudinal seals are placed between the rotary drum and the surrounding casing. The filtrates from the respective zones are separated by seals in a peripheral end valve arranged at one or both of the end walls of the drum.

A problem with known drum washers is that the drum during rotation often presents an irregular and even "jerky" operation. It is desirable, both in view of costs and in view of washing effectiveness, that functioning of the drum washer be reliable and that its components be put under as low a load as possible. With an irregular loading, however, the performance of the drum washer runs the risk of being noticeably impaired and in addition the wear on its constituting parts increases.

One object of the present invention is to provide an improved washing apparatus of the type comprising a compartmented drum. In particular, the present invention aims at achieving a more regular running of the washing apparatus when it is in operation and the drum consequently rotates.

SUMMARY OF THE INVENTION

In accordance with the present invention, these and other objects have now been realized by the invention of a washer for washing and dewatering cellulosic pulp material comprising a rotary drum including a plurality of axial compartment walls separated by a predetermined distance disposed along the rotary drum defining a plurality of external axial compartments therebetween, a stationary cylindrical casing enclosing the rotary drum, thereby defining a ring-shaped space between the rotary drum and the stationary cylindrical casing, a plurality of axially extending seals having a predetermined width dividing the ring-shaped space into a forming zone for forming the cellulosic pulp material, at least one washing zone for washing the cellulosic pulp material, and a discharge zone for discharging the washed cellulosic pulp material, the predetermined width of the plurality of axially extending seals being at least as great as the predetermined distance between the plurality of axial compartment walls, at least two of the plurality of axially extending seals being displaced along the circumference of the rotary drum whereby upon rotation of the rotary drum the at least two of the plurality of axially extending seals contact adjacent sets of the plurality of axial compartment walls at different times. Preferably, the predetermined distance comprises a substantially uniform distance between each of the plurality of axial compartment walls, and the distance between adjacent ones of the plurality of axially extending seals varies along the circumference of the rotary drum whereby the different times are determined by the position of the plurality of axially extending seals.

In accordance with one embodiment of the washer of the present invention, the displacement of at least two of the axially extending seals is substantially evenly distributed therealong.

In accordance with another embodiment of the washer of the present invention, the majority of the plurality of axially extending seals are displaced along the circumference of the rotary drum. Preferably, each of plurality of axially extending seals is displaced with respect to the plurality of axially extending seals. In a preferred embodiment, each of the plurality of axially extending seals is displaced with respect to others of the plurality of axially extending seals, and the displacement is evenly distributed along the circumference of the rotary drum whereby the substantially uniform distance between the plurality of axial compartment walls (x) are positioned with a displacement of (x)/(n), (n) being the number of the plurality of axially extending seals.

The present invention is based on an understanding that the problem with irregular running of drum washers to a large extent is related to the contact between the zone-dividing axial seals and the compartment walls of the drum when the drum rotates. In known washers, these seals actuate at the same point in time, whereby the washing apparatus is subject to large variations in load, which results in an irregular and sometimes "jerky" operation. According to the present invention, a washing apparatus is instead proposed where at least two and preferably a plurality of the longitudinal (axial) seals are arranged such that, when the drum rotates, they meet compartment walls at shifted points in time with respect to each other. This can be achieved by arranging the seals along the circumference of the drum at different positions with respect to their respective opposite axial compartment walls.

By designing the washing apparatus in the above way, the running of the drum becomes considerably smoother. Jerky operation can be avoided, which in turn leads to elimination or a decrease in several unwanted effects, such as varying moment, load, wear and pressure impacts in the hydraulic system of the washing apparatus. Thus, in this manner a washing apparatus with improved performance and increased durability is obtained by means of the present invention.

According to a preferred embodiment of the present invention, each of the longitudinal seals is shifted/displaced in comparison to all others. According to another preferred embodiment of the present invention, the shifting/displacement of the longitudinal seals is substantially evenly distributed therealong. These may be combined with advantage in order to obtain a washing apparatus that presents a running as regular as possible.

BRIEF DESCRIPTION OF THE DRAWINGS

The present invention, and also additional objects and advantages thereof, is best understood by reference to the subsequent detailed description which in turn refers to the attached drawings, where.

DETAILED DESCRIPTION

Figure 1:
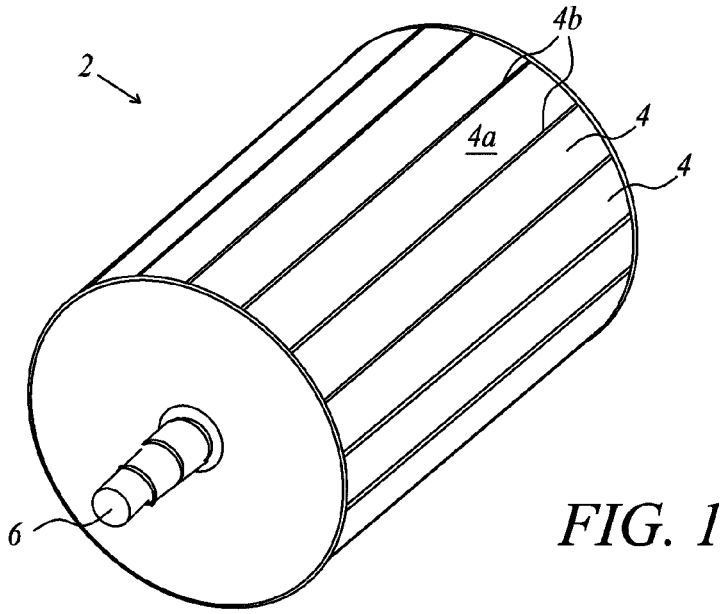
FIG. 1 is a side, schematic, perspective view of a compartmented rotary drum that can be used in a washing apparatus according to the present invention.

Referring to the drawings, in which corresponding reference numbers are used, that is the same end numerals, for similar or corresponding parts, FIG. 1 is a schematic perspective view of a compartmented rotatable drum that can be included together with a stationary casing in a pressurized displacement washer according to the present invention. A rotatable drum 2 provided with a plurality of outer compartments (also called pulp compartments or cells) 4 is shown, in which compartments the paper pulp to be washed is placed upon its feeding against the drum surface. Each compartment 4 has a bottom 4*a* of perforated metal sheet, as well as two compartment walls (cell walls) 4*b* arranged axially with reference to the shaft 6 of the drum. The compartment walls 4*b* of the drum illustrated in FIG. 1 are evenly distributed along the circumference of the drum. The rotatable drum 2 is in general rotatably journalled on a stationary support (not shown) in the washing apparatus and enclosed by a cylindrical casing 108, whereby an annular space 110 is defined between the casing and the drum. (See FIG. 2 for example.)

Figure 2:
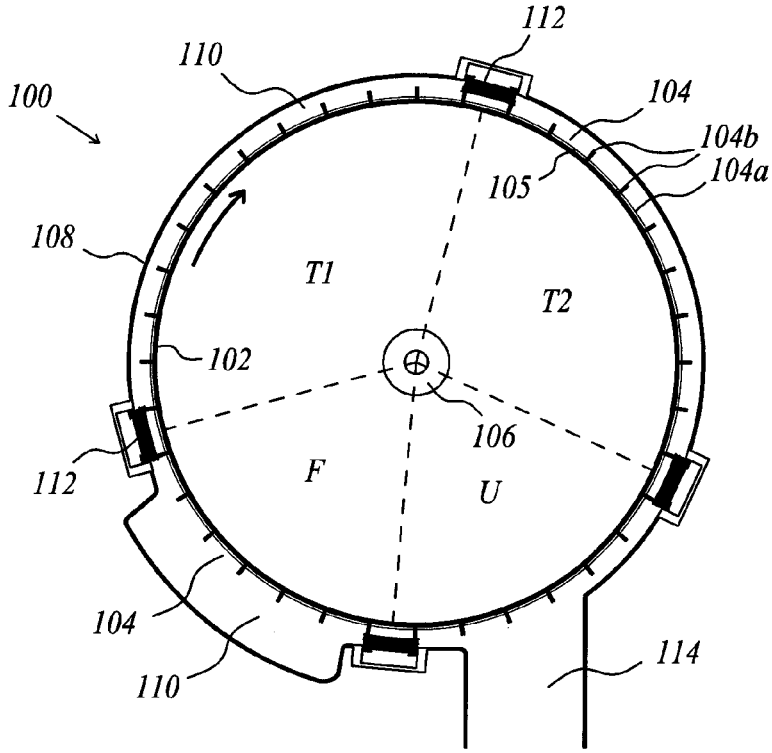
FIG. 2 (Prior art)
FIG. 2 is a side, elevational, cross-sectional, schematic view of a washing apparatus with a compartmented drum according to the prior art.

In FIG. 2 an axial cross-section through a washing apparatus with a compartmented drum according to the prior art is shown. The drum 102 is rotatably arranged with respect to a shaft 106. The washing apparatus 100 comprises a plurality of axial longitudinal seals 112 placed between the rotating drum 102 and the surrounding casing 108. These longitudinal seals 112 between the casing 108 and the compartment walls 104*b* of the compartments serve as separating members between different zones F, T1, T2, U of the washing apparatus 100. The function of the seals 112 is of greatest importance e.g. in order to ensure that washing liquid intended for a specific washing stage is not moved to a subsequent washing stage, in particular since there is normally a difference in pressure between different washing stages. The illustrated washing arrangement 100 is provided with four longitudinal seals 112 that consequently divide the annular space 110 into four zones, more specifically in a forming zone F for forming of the pulp in the compartments 104 of the drum, first and second washing zones, T1 and T2, for washing the formed pulp, and a discharge zone U for discharge of the washed pulp.

A drum washer 100 of the above described design operates with continuously rotating drum 102 according to the following principle. Pulp for washing is fed into forming zone F (the inlet is not shown), whereby the pulp is placed in the compartments 104 of the drum 102, in the axial direction of the drum, as long and narrow rectangles against the perforated metal sheet that constitutes the compartment bottom 104*a*. The compartmentalization of the drum ensures that the forming of the pulp cake is maintained. Washing liquid is supplied to the annular space 110 and the filtrate is squeezed out of the pulp and thereupon passes through the perforated metal sheet. Preferably, this occurs at an overpressure in order to achieve improved dewatering of the pulp. The perforated metal sheet is placed at a distance from the drum 102 such that filtrate channels 105 are formed in the space between the drum 102 and the perforated metal sheet. The washing may, as in FIG. 2, be repeated in two or more stages at different pressures and with separate washing liquids. Used liquid is normally brought back to a preceding washing stage or out from the washing apparatus and to previous process stages. The washed pulp is discharged through an outlet opening 114.

In known drum washers the longitudinal axial seals that seal between different stages/zones are arranged such that all seals actuate simultaneously. Hence, when one seal meets a compartment wall, so do the other seals. This is clearly illustrated in FIG. 2, which shows the washing arrangement 100 in a position where every seal 112 is positioned above two opposite compartment walls 104*b*. The seals 112 are thus all in the same position with respect to the closest compartment walls 104*b*. This results in an irregular and more or less "jerky" operation, which as mentioned has a negative impact on the performance and durability of the apparatus.

In view of this, according to the present invention there is proposed a washing arrangement where at least two of the longitudinal seals of the washing apparatus are arranged such that, when the drum rotates, they meet axial compartment walls at shifted points in time with respect to each other. By arranging the longitudinal seals such that they are at different positions (i.e. at different locations) with respect to opposite compartment walls, the load on the drum becomes smaller and the whole washing arrangement will have a smoother and more reliable running, which as described above results in a number of advantages.

Thus, according to the present invention a washing arrangement is provided for washing and dewatering of cellulose pulp, comprising a rotatable drum with a plurality of outer compartments on the drum for the pulp that is to be washed, which compartments are defined by axial compartment walls distributed along the circumference of the drum, a stationary cylindrical casing that encloses the drum whereby an annular space is defined between the casing and the drum and where the annular space, by means of longitudinal seals in the axial direction of the drum, is divided in zones for forming, washing and discharge of pulp, where at least two of the longitudinal seals are arranged such that, when the drum rotates, they meet axial compartment walls at shifted points in time with respect to each other.

The zone separating seals are, according to the present invention, arranged along the circumference of the drum with mutual displacement, i.e. at different distances in the circumferential direction with respect to respective opposite axial compartment walls. This displacement may be achieved by appropriately selected positions of seals and/or compartment walls. However, in general it is desirable to maintain a substantially constant distance between adjacent compartment walls along the entire circumference of the drum, and therefore the seals are suitably displaced with respect to each other by means of a varying distance between adjacent seals along the circumference of the drum. In such a case the displacement is solely determined by the position of the seals around the casing.

Figure 3:
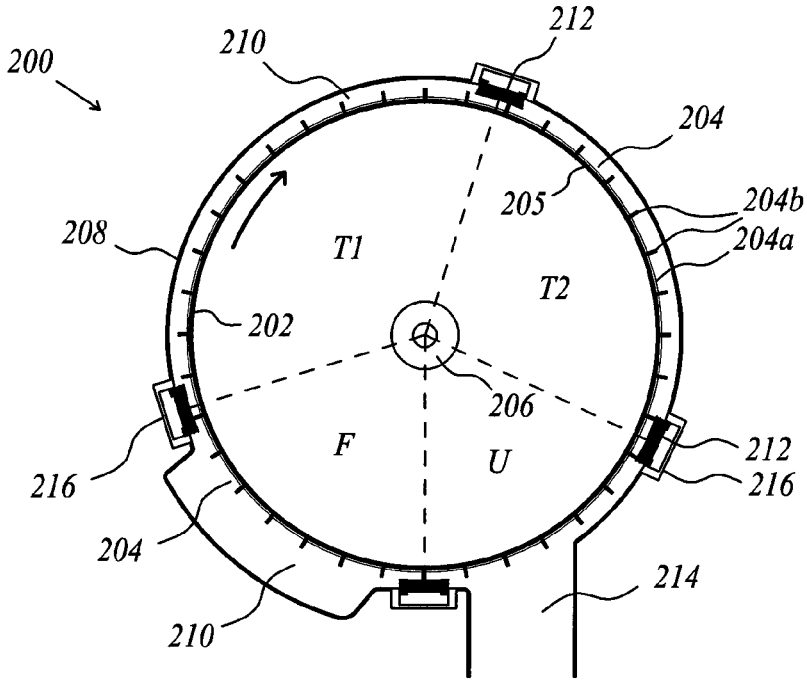
FIG. 3 is a side, elevational, cross-sectional view of a washing apparatus with a compartmented drum according to a first embodiment of the present invention.

FIG. 3 shows, in an axial cross-section, a compartmented drum washer according to a preferred embodiment of the present invention. The washing apparatus 200 comprises a rotatable drum 202, a stationary casing 208 and four longitudinal seals 212 arranged between the casing 208 and the drum 202. The drum 202 rotates around the shaft 206 and is provided with axial compartments 204 evenly distributed along its circumference. The distance between two adjacent compartment walls 204*b* is, in other words, substantially constant. The rotatable drum 202, including its compartment walls 204*b*, is normally made of steel. The longitudinal seals 212 may also be of a metallic material, but is preferably made of a polymeric material, intended to be replaced by means of specific openable parts 216 in the casing 208.

Each seal 212 has a width which is somewhat larger than the distance between two adjacent compartment walls 204*b*. Accordingly, the compartment walls 204*b* will pass the seal 212 one by one as the drum 202 rotates, and the position of the seal is such that at every point in time it "covers" either one or two compartment walls 204*b*. Furthermore, the seal 212 typically presents a length that essentially corresponds with, or is somewhat larger than, the length of the compartments 204 it is to seal against. In the axial direction it may e.g. extend in principle along the entire drum. Alternatively, the drum may exhibit two (or more) separate seals in the axial direction, such as when the drum is provided with a ring structure that divides each compartment in two parts ("rectangles") in the axial direction, such that the filtrate can be conducted out from both of the end walls of the drum.

The longitudinal seals 212 are displaced in comparison to each other with regard to their meeting with the compartment walls 204*b* when the rotatable drum 202 is in operation. In the illustrated example in FIG. 3 each and every one of the longitudinal seals is displaced with respect to all of the others. This implies that all of the individual seals will actuate, i.e. come into sealing position, at different points in time.

A "meeting" between a compartment wall and a seal in this description means the condition/point in time when a seal and a compartment wall are at least partly at corresponding positions seen radially. This "meeting" does not necessary imply any actual physical contact. The seals may, for example, be arranged at a certain distance from the drum and its compartment walls, whereby the contact originating from the meeting occurs by means of the pulp that is compressed in the compartments.

The displacement of the longitudinal seals 212 is preferably substantially evenly distributed in order to achieve as smooth an operational running as possible. In cases where the distance x in the circumferential direction between two compartment walls 204*b* is constant, this means that the displaced seals are positioned with a displacement, in pairs, of x/m, where m is the number of displaced longitudinal seals in the washing arrangement. In the special case where all of the longitudinal seals are displaced in comparison to each other, those are hence arranged, in pairs, with displacements of x/n, where n is the number of longitudinal seals in the washing arrangement (m=n=4 in FIG. 3).

Figure 4:
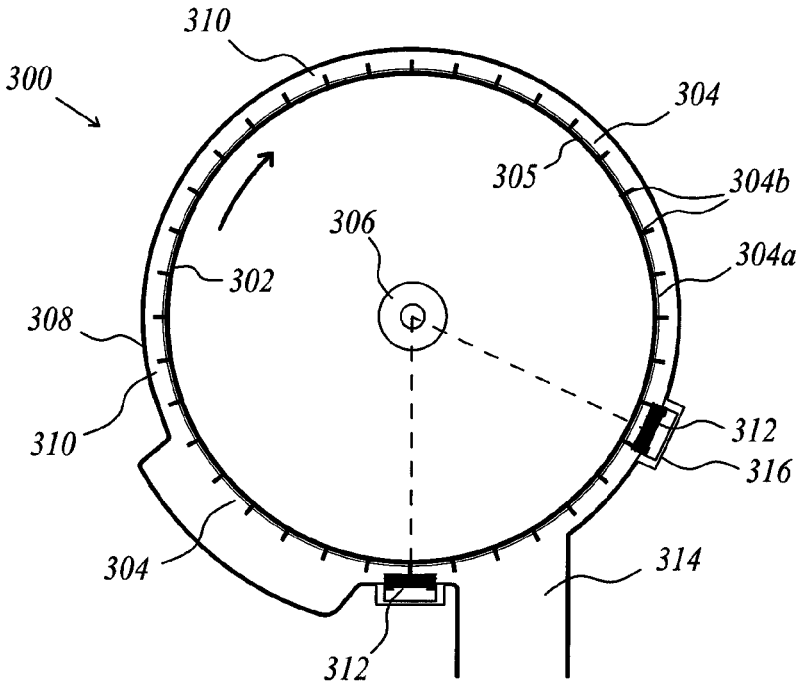
FIG. 4 is a side, elevational, cross-sectional view of a washing apparatus having a compartmented drum according to a second embodiment of the present invention.

The washing arrangement in FIG. 3 presents, in the circumferential direction of the drum, four zones, F, T1, T2, and U, that are divided by longitudinal/axial seals 212. Nevertheless, it is to be understood that the present invention by no means is limited to such embodiments, but can be applied to different constructions of washing apparatus with varying number of zones (and seals). This is e.g. shown in FIG. 4, which shows a washing apparatus 300 that (in cross-section) is provided with two longitudinal seals 312 differently displaced in comparison to opposite compartment walls with evenly distributed displacement, or in FIG. 5 the washing apparatus 400 of which comprises five longitudinal seals 412.

Figure 5:
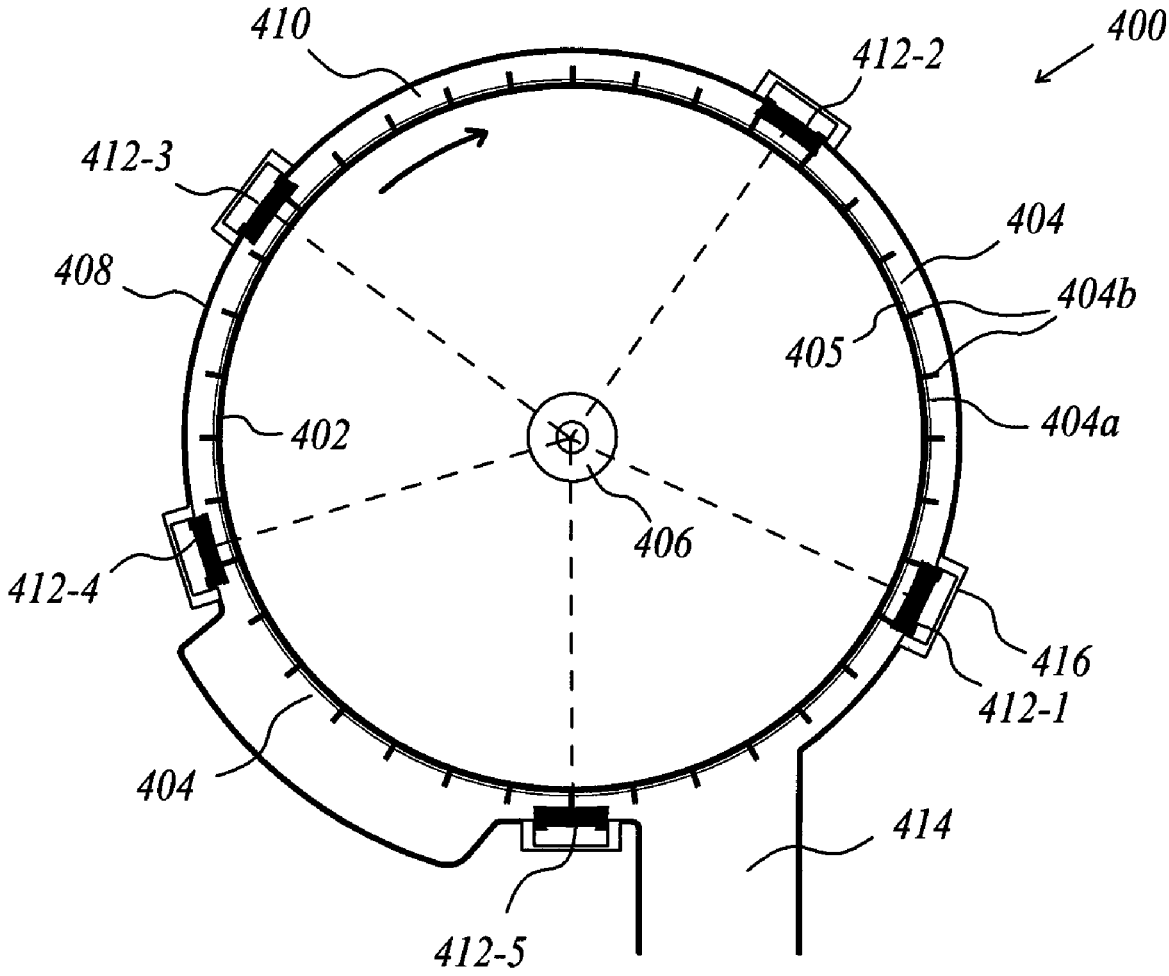
FIG. 5 is a side, elevational, cross-sectional view of a washing apparatus having a compartmented rum according to a third embodiment of the invention.

Also, cases where some seals actuate simultaneously while others have the preferred displacement are within the scope of the present invention. Such a design is shown in FIG. 5, where seal 412-1 and seal 412-2 will meet opposite compartment walls, respectively, at the same point in time, while the other seals 412-3,412-4,412-5 actuate at other points in time, separate from each other. The present invention results in a greater improvement of the performance and the durability of the washing arrangement the larger share of longitudinal seals in the washing arrangement that are differently displaced with respect to opposite compartment walls, and it is preferred that the majority of the longitudinal seals are displaced differently with respect to their opposite compartment walls.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A washer for washing and dewatering cellulosic pulp material comprising a rotary drum including a plurality of axial compartment walls separated by a predetermined distance disposed along said rotary drum defining a plurality of external axial compartments therebetween, a stationary cylindrical casing enclosing said rotary drum, thereby defining a ring-shaped space between said rotary drum and said stationary cylindrical casing, a plurality of axially extending seals having a predetermined width dividing said ring-shaped space into a forming zone for forming said cellulosic pulp material, at least one washing zone for washing said cellulosic pulp material, and a discharge zone for discharging said washed cellulosic pulp material, said predetermined width of said plurality of axially extending seals being larger than said predetermined distance between said plurality of axial compartment walls, at least two of said plurality of axially extending seals being arranged along the circumference of said rotary drum at different positions with respect to respective opposite axial compartment walls whereby upon rotation of said rotary drum said at least two of said plurality of axially extending seals contact adjacent sets of said plurality of axial compartment walls at different times.

2. The washer of claim 1 wherein said predetermined distance comprises a substantially uniform distance between each of said plurality of axial compartment walls, and the distance between adjacent ones of said plurality of axially extending seals varies along the circumference of said rotary drum whereby said different times are determined by the position of said plurality of axially extending seals.

3. The washer of claim 1 wherein said displacement of at least two of said axially extending seals is substantially evenly distributed therealong.

4. The washer of claim 1 wherein the majority of said plurality of axially extending seals are displaced along said circumference of said rotary drum.

5. The washer of claim 4 wherein each of said plurality of axially extending seals is displaced with respect to said plurality of axially extending seals.

6. The washer of claim 5 wherein each of said plurality of axially extending seals is displaced with respect to others of said plurality of axially extending seals, and said displacement is evenly distributed along the circumference of said rotary drum whereby said substantially uniform distance between said plurality of axial compartment walls (x) are positioned with a displacement of (x)/(n), (n) being the number of said plurality of axially extending seals.

* * * * *